United States Patent [19]

Nigro

[11] 4,348,126

[45] Sep. 7, 1982

[54] BRUSH ASSEMBLY

[75] Inventor: Louis V. Nigro, Saugus, Mass.

[73] Assignee: The Gillette Company, Boston, Mass.

[21] Appl. No.: 206,520

[22] Filed: Nov. 13, 1980

[51] Int. Cl.[3] ..... A46B 11/02; A46B 17/04

[52] U.S. Cl. ..... 401/135; 401/175; 401/269; 401/288; 222/568

[58] Field of Search ..... 222/568; 401/175, 135, 401/190, 269, 288

[56] References Cited

U.S. PATENT DOCUMENTS

| | | | |
|---|---|---|---|
| 809,634 | 1/1906 | Schon | 222/568 |
| 1,067,596 | 7/1913 | Fesler | 401/175 |
| 1,878,027 | 9/1932 | Tremolada | 401/175 |
| 1,907,376 | 5/1933 | Weck . | |
| 1,936,261 | 11/1933 | Pierson | 401/175 |
| 1,946,867 | 2/1934 | Mathieu | 401/175 |
| 2,601,039 | 6/1952 | Livingstone | 222/568 |
| 2,873,886 | 2/1959 | Miskel | 222/568 |
| 2,922,178 | 1/1960 | Kelly | 15/135 |
| 3,115,283 | 12/1963 | Lindgren | 222/568 |
| 3,294,293 | 12/1966 | Johns | 222/568 |
| 3,370,908 | 2/1968 | Cupp | 401/190 |
| 3,825,157 | 7/1974 | Herzig | 222/212 |
| 4,019,654 | 4/1977 | van Manen | 222/1 |

FOREIGN PATENT DOCUMENTS

| | | | |
|---|---|---|---|
| 72278 | 3/1951 | Denmark | 222/568 |
| 567649 | 3/1924 | France | 401/175 |
| 935259 | 2/1948 | France | 401/135 |
| 131066 | 4/1929 | Switzerland | 401/175 |
| 23685 | of 1896 | United Kingdom | 401/175 |
| 864439 | 4/1961 | United Kingdom | 401/190 |

*Primary Examiner*—Clyde I. Coughenour
*Attorney, Agent, or Firm*—Mandel E. Slater

[57] ABSTRACT

A brush assembly comprising a brush portion and a cartridge portion, the brush portion comprising an elongated housing open at a first end thereof, a bristle-retaining wall at a second end thereof, the brush portion housing having therein first connecting structure for releasably connecting the brush portion to the cartridge portion, the cartridge portion comprising a cartridge housing adapted to be inserted in the brush portion by way of the open first end of the brush portion, the cartridge housing defining a chamber adapted to retain a fluid, second connecting structure disposed on the cartridge portion for releasable connection to the first connecting structure, and actuator and valve structure adapted to facilitate movement of the fluid in selected amounts from the cartridge to the bristles of the brush portion.

2 Claims, 1 Drawing Figure

BRUSH ASSEMBLY

BACKGROUND OF THE INVENTION

1. Field of the Invention

The invention relates to brushes for personal use and is directed more particularly to a fountain-type brush having a replaceable reservoir of fluid.

2. Description of the Prior Art

Fountain-type brushes for personal use are generally known. For example, U.S. Pat. No. 3,093,857, issued June 18, 1963, to A. Hersh, and U.S. Pat. No. 3,370,908, issued Feb. 27, 1968 to J. F. Cupp show brush assemblies including aerosol dispensers for delivering material to the brush bristle area: U.S. Pat. No. 1,339,065, issued May 4, 1920 to W. H. McEvilla and U.S. Pat. No. 2,922,178 issued Jan. 26, 1960 to E. G. Kelly disclose brush assemblies including tubes for delivering material to the brush area; U.S. Pat. No. 1,067,596, issued July 15, 1913 to J. B. Fesler and U.S. Pat. No. 4,201,490, issued May 6, 1980 to A. D'Angelo are illustrative of the type brush assembly in which a piston, or plunger, in a cylinder, is used to extrude fluid in the bristle region. In several of the prior art assemblies, the reservoir of fluid material is replaceable, as for example, in Hersh and McEvilla.

SUMMARY OF THE INVENTION

An object of the present invention is to provide an improved brush assembly for personal use, the brush assembly being of the fountain-type and having a replaceable cartridge portion serving as a reservoir for fluid, such as shaving lather, or the like.

With the above and other objects in view, as will hereinafter appear a feature of the present invention is the provision of a brush assembly comprising a brush portion and a cartridge portion, the brush portion comprising an elongated housing open at a first end thereof, a bristle-retaining wall at a second end thereof, the wall having an opening extending therethrough, a collar disposed about the opening and extending from an interior surface of the wall toward the first end, a retainer ring of elastomeric material fixed to the collar, the retainer ring having an annular wall defining in part an annular recess, the collar being disposed in the recess, the retainer ring having a central tubular portion defining in part the annular recess and extending into the opening, a flexible sleeve disposed in the opening, a first end of the sleeve being open and having a circular base portion, the base portion being clamped between the retainer ring and the collar, a second end of the sleeve being disposed in a body of bristles, the housing having therein first connecting means for releasably connecting the brush portion to the cartridge portion, the cartridge portion comprising a cartridge housing adapted to be inserted in the brush portion by way of the open first end of the brush portion, the cartridge housing defining a chamber adapted to retain a fluid, a spindle extending through a first end of the cartridge housing, manual turning means fixed to the spindle and disposed on an exterior surface of the first cartridge end, the spindle having a threaded portion, a piston threadedly disposed on the spindle and adapted, upon rotation of the spindle, to move in the chamber toward a second end of the cartrige housing, an exterior side of the cartridge housing second end having a shoulder portion adapted to engage the retainer ring annular wall to effect a seal between the brush portion and the cartridge portion, a nozzle extending from the cartridge housing second end and adapted to be received in a pocket formed by the annular wall, the nozzle being adapted to be aligned with the tubular portion, and second connecting means disposed on the cartridge portion for releasable connection to the first connecting means.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent.

In the drawings.

DESCRIPTION OF THE PREFERRED EMBODIMENT

Figure 1:
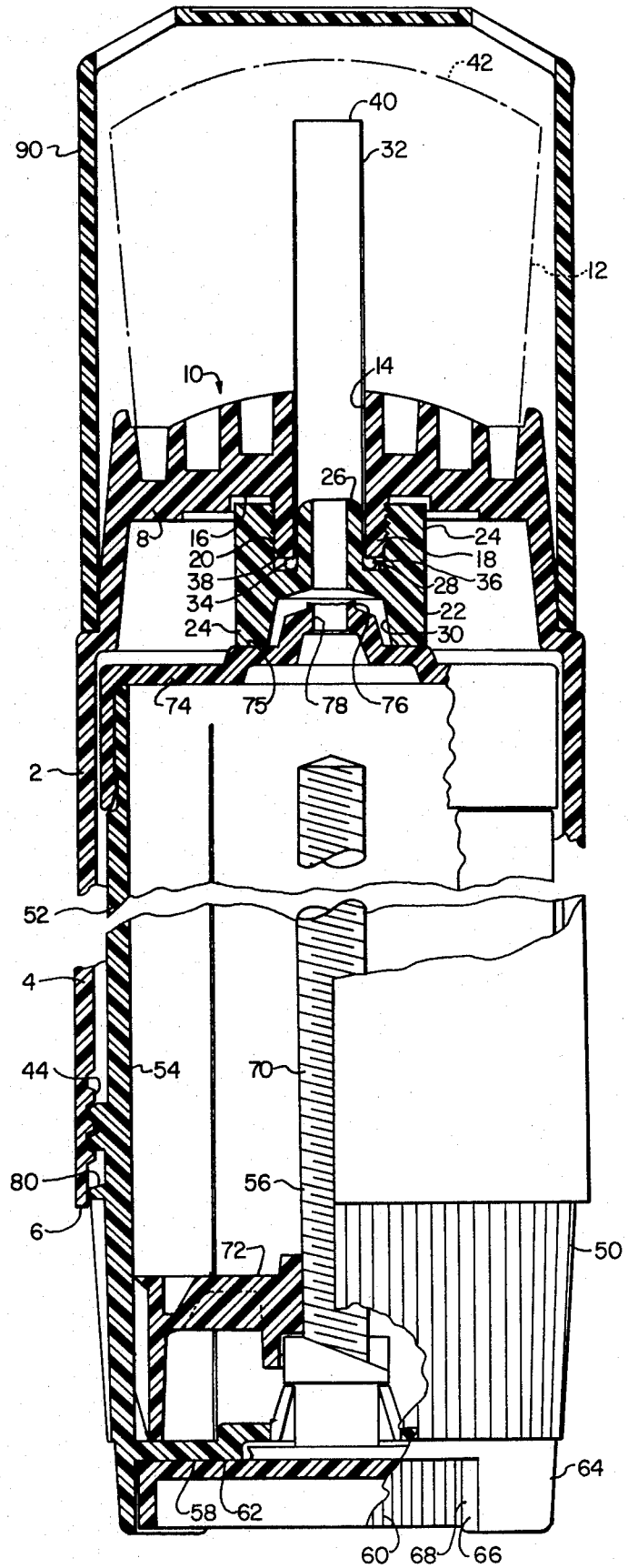
FIG. 1 is an elevational view, partly broken away and partly in section, of one form of brush assembly illustrative of an embodiment of the invention.

Referring to FIG. 1, it will be seen that the illustrative brush assembly includes a brush portion 2 having an elongated housing 4 open at a first end 6 thereof. A bristle-retaining wall 8 is disposed at a second end 10 of the housing 4 and has anchored therein bristles 12 adapted for a desired task, as for example, bristles adapted for lathering a surface area to be shaved by a razor blade.

The wall 8 is provided with a central opening 14 therethrough. Extending from an interior surface 16 of the wall 8 is a collar portion 18 disposed about the opening 14. The collar portion 18 is preferably provided with external teeth or projections 20.

The brush portion 2 further includes a retainer ring 22 of elastomeric material disposed on the collar portion 18, the projections 20 serving to retain the ring 22 on the collar 18. The retainer ring includes an annular wall 24 surrounding a central tubular portion 26, the annular wall 24 and tubular portion 26 defining an annular recess 28 in which is disposed the collar portion 18. The annular wall 24 also forms in part a pocket 30 formed on the underside of the retainer ring 22.

A flexible sleeve 32 is disposed in the opening 14. A first end 34 of the sleeve 32 is open and has a circular base portion 36 which is clamped between the retainer ring 22 and the end 38 of the collar portion 18. The sleeve 32 is disposed on the tubular portion 26 and has a second open end 40 near the surface 42 of the bristles 12. The sleeve 32 acts essentially as a flexible extension of the tubular portion 26 and carries fluid passing through the tubular portion 26 to a point proximate the working surface 42 of the bristles 12.

The housing 4 is provided with a first connecting means, preferably in the form of internal threads 44, for releasably connecting the brush portion to a cartridge portion, to be described below.

The illustrative brush assembly includes a cartridge portion 50 having a cartridge housing 52 adapted to be inserted in the brush portion 2 by way of the open first end 6 of the brush portion. The cartridge housing 52 defines a chamber 54 adapted to retain a fluid, such as shaving lather, for application to a surface by the bristles 12.

A spindle 56 extends through a first end 58 of the cartridge housing 52. A manual turning means, preferably in the form of a circular knob 60 is fixed to the spindle and is disposed on an exterior surface 62 of the first cartridge end 58. The first cartridge end may be provided with an interrupted skirt 64 depending from the cartridge housing 52 and disposed around the knob 60, the interruptions 66 in the skirt 64 defining openings 68 for manual access to the periphery of the knob.

The spindle 56 is provided with a threaded portion 70 having threadedly mounted thereon a piston 72. Upon rotation of the knob 60, and thereby the spindle 56, the piston 70 is caused to move axially in said chamber toward a second end 74 of the cartridge housing.

The cartridge housing second end 74 is provided with an external shoulder portion 75 adapted to engage the retainer ring annular wall 24 to effect a seal between the brush portion 2 and the cartridge portion 50.

A nozzle 76 extends outwardly from the cartridge second end 74 and is adapted to be received, as will be further described below, in the pocket 30 on the underside of the retainer ring 22. The nozzle is adapted to be aligned with the tubular portion 26 of the retainer ring 22. The nozzle 76 is preferably closed (not shown) at purchase, but is adapted to be snipped open, for example, to provide an orifice 78 at the end thereof prior to insertion of the nozzle in the pocket 30.

The cartridge portion is provided with second connecting means, preferably in the form of external threads 80, for releasable connection to the internal threads 44 of the brush portion 2.

In use, a user snips the tip off the nozzle 76 of the cartridge portion 50 and inserts the cartridge portion into the open end 6 of the brush housing 4. Upon engagement of the threads 80 and 44, the user screws the cartridge portion into the brush portion until the shoulder portion 75 is in firm engagement with the retainer ring 22, the nozzle 76 being thereby disposed in the pocket 30.

To dispense a shaving cream, or the like, onto the bristles, the operator engages the knob 60 through the openings 68 and turns the knob on its axis. The configuration of the skirt 64 limits the turning of the knob to small increments to assist in preventing dispensing more fluid than is required. Turning of the knob 60 causes rotation of the spindle 56, causing axial movement of the piston 72 along the threaded portion 70 of the spindle. Movement of the piston 72 toward the cartridge second end 74 forces fluid in the chamber 54 to move through the nozzle 76, the tubular portion 26, and the sleeve 32, into the bristles 12 near their working surface 42.

Upon exhaustion of the supply of fluid, the cartridge portion is removed from the brush portion and replaced by a fresh cartridge portion.

There may be provided an overcap 90 adapted for a friction fit on the brush portion 2 to cover the bristles 12 when the assembly is not in use.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A brush assembly comprising a brush portion and a cartridge portion, said brush portion comprising an elongated housing open at a first end thereof, a bristle-retaining wall at a second end thereof, said wall having an opening extending therethrough, a collar disposed about said opening and extending from an interior surface of said wall toward said first end, a retainer ring of elastomeric material fixed to said collar, said retainer ring having an annular wall defining in part an annular recess, said collar being disposed in said recess, said retainer ring having a central tubular portion defining in part said annular recess and extending into said opening, a flexible sleeve disposed in said opening, a first end of said sleeve being open and having a circular base portion, said base portion being clamped between said retainer ring and said collar, a second end of said sleeve being disposed in a body of bristles, said housing having therein first connecting means comprising internal threads on a wall portion of said brush portion housing for releasably connecting said brush portion to said cartridge portion, said cartridge portion comprising a cartridge housing adapted to be inserted in said brush portion by way of said open first end of said brush portion, said cartridge housing defining a chamber adapted to retain a fluid, a spindle extending through a first end of said cartridge housing, manual turning means fixed to said spindle and disposed on an exterior surface of said first cartridge end, said manual turning means comprising a circular knob, and including an interrupted skirt depending from said cartridge housing first end and disposed around said knob, the interruptions in said skirt defining openings for manual access to the periphery of said knob, said spindle having a threaded portion, a piston threadedly disposed on said spindle and adapted, upon rotation of said spindle, to move in said chamber toward a second end of said cartridge housing, an exterior side of said cartridge housing second end having a shoulder portion adapted to engage said retainer ring annular wall to effect a seal between said brush portion and said cartridge portion, a closed nozzle extending from said cartridge housing second end and adapted to be opened to provide an orifice at the end thereof and to be received in a pocket formed by said annular wall, said nozzle being adapted to be aligned with said tubular portion, and second connecting means comprising external threads on a wall portion of said cartridge portion for releasable connection to said first connecting means.

2. The invention in accordance with claim 1 including a cover member adapted to be releasably connected to said brush portion and enclose said bristles therein.

* * * * *